US008739345B2

(12) United States Patent
Palmer

(10) Patent No.: US 8,739,345 B2
(45) Date of Patent: Jun. 3, 2014

(54) DOWN HOLE CLEANING TOOL

(75) Inventor: Jane Palmer, Halesowen (GB)

(73) Assignee: Industrial Brushware Limited, Halesowen (GB)

( * ) Notice: Subject to any disclaimer, the term of this patent is extended or adjusted under 35 U.S.C. 154(b) by 0 days.

(21) Appl. No.: 13/260,905

(22) PCT Filed: Mar. 17, 2010

(86) PCT No.: PCT/GB2010/000480

§ 371 (c)(1), (2), (4) Date: Sep. 28, 2011

(87) PCT Pub. No.: WO2010/112807

PCT Pub. Date: Oct. 7, 2010

(65) Prior Publication Data

US 2012/0017385 A1 Jan. 26, 2012

(30) Foreign Application Priority Data

Mar. 31, 2009 (GB) ..... 0905506.2

(51) Int. Cl.

| | |
|---|---|
| ***A46B 15/00*** | (2006.01) |
| ***B08B 9/02*** | (2006.01) |
| ***B08B 9/04*** | (2006.01) |

(52) U.S. Cl.

USPC ..... 15/104.16; 15/104.19; 15/104.05

(58) Field of Classification Search

USPC ..... 15/104.19, 104.05

IPC ..... B08B 9/02,9/04; A46B 15/00

See application file for complete search history.

(56) References Cited

U.S. PATENT DOCUMENTS

| | | | | |
|---|---|---|---|---|
| 1,336,673 | A * | 4/1920 | Berntson | 15/104.19 |
| 1,677,050 | A * | 7/1928 | Reed et al. | 166/175 |
| 2001/0042623 | A1 | 11/2001 | Reynolds | |

FOREIGN PATENT DOCUMENTS

| | | | |
|---|---|---|---|
| DE | 579919 | C | 6/1993 |
| DE | 20117781 | | 3/2002 |
| GB | 191020137 | | 12/1910 |
| GB | 362614 | | 12/1931 |
| GB | 362614 | A | 12/1931 |
| GB | 2442480 | | 4/2008 |
| JP | 60086489 | U | 11/1983 |
| JP | 60086489 | | 6/1985 |
| JP | 2002316113 | A | 10/2002 |
| NL | 8402419 | | 3/1986 |

* cited by examiner

*Primary Examiner* — Monica Carter
*Assistant Examiner* — Stephanie Berry
(74) *Attorney, Agent, or Firm* — Fulwider Patton LLP

(57) ABSTRACT

A cleaning apparatus (2) comprising a hollow first cylindrical end collar (4), a hollow second cylindrical end collar (6) and a substantially tubular cleaning section, open at each end, extending therebetween, wherein the tubular cleaning section comprises a plurality of elongate strip brushes (8) disposed between the first cylindrical collar (4) and the second cylindrical collar (6) and arranged such that there are radical openings in the tubular cleaning section between said elongate strip brushes (8).

5 Claims, 2 Drawing Sheets

DOWN HOLE CLEANING TOOL

CROSS-REFERENCE TO RELATED APPLICATION

This is a National Phase of PCT/GB2010/000480, filed 17 Mar. 2010, claiming priority from United Kingdom Application No. 0905506.2, filed 31 Mar. 2009.

The present invention relates to a cleaning apparatus for cleaning pipes. The invention has particular, but not exclusive, application to the cleaning of pipes in the oil, gas and water drilling industries. The invention will be understood to include apparatus for the cleaning of other pipes.

Pipes may often require cleaning while fluid is flowing in the pipes, if the pipes are not to be decommissioned and drained while cleaning occurs. It will be understood that, for example, in oil pipelines this is a solution to be avoided and that cleaning while fluid flow occurs is highly desirable.

To meet this need, apparatus known as pipeline cleaning pigs and down hole cleaning tools have been developed. Such apparatus are introduced into the pipe to be cleaned and caused to travel the length of the pipe. The apparatus is provided with means to clean, for example by scouring or abrasion, the interior surface of the pipe. However, known apparatus suffer from a number of disadvantages.

In the drilling industries it is known to provide well casings in boreholes. The internal surfaces of such casings require cleaning from time to time both for maintenance and to prevent blockages arising. A variety of cleaning tools are known for this purpose. It is known for cleaning tools to be driven down the passage to be cleaned by flow of fluid material through the passage. For example, in an oil pipeline, the cleaning tool is driven through the pipeline by the flow of oil. However, a number of problems are known to arise. In particular, the cleaning tool might not contact the entire 360 degree circumference of the surface to be cleaned such that complete cleaning does not occur unless a sufficient degree of rotation is imparted to the cleaning tool.

It is important to allow for fluid flow through the cleaning apparatus. Otherwise a head of pressure can build ahead of the cleaning apparatus causing the cleaning apparatus to jam within the pipe causing a further obstruction to the desired fluid flow.

It is known to provide a cleaning tool provided with brushes to scour clean the internal surface. If there is insufficient bypass of the fluid material the brushes can become clogged thereby preventing further cleaning. There is a considerable amount of work and expense in removing such cleaning tools from the pipes and subsequently reconditioning such cleaning tools for reuse.

It is an advantage of the present invention that it seeks to eliminate, or at least substantially reduce, these problems.

According to the present invention, a cleaning apparatus comprises a hollow first cylindrical end collar, a second hollow cylindrical end collar and a substantially tubular cleaning section, open at each end, extending therebetween, wherein the tubular cleaning section comprises a plurality of elongate strip brushes disposed between the first cylindrical collar and the second cylindrical collar and arranged such that there are radial openings in the tubular cleaning section between said elongate strip brushes.

This has an advantage that a high degree of bypass through the cleaning apparatus is permitted through its central open tubular structure. Furthermore the radial openings enable any debris cleaned from the interior of a pipe to escape from the cleaning area and to be carried away in the fluid flow passing through the centre of the cleaning apparatus.

Preferably, the strip brushes are of undulating configuration. More preferably, the strip brushes are sinusoidal in configuration.

Preferably a first end of each strip brush is connected to the first cylindrical collar at a first point and a second end of each strip brush is connected to the second cylindrical collar at a second point, the first and second points being angularly offset from one another.

This has as a further advantage that 360 degree contact with a surface to be cleaned can be ensured.

Preferably, the first cylindrical collar and the second cylindrical collar are connected only by the cleaning means. This also assists in permitting a high degree of bypass.

Preferably, the strip brushes are not connected to one another in a region extending between the first cylindrical collar and the second cylindrical collar. In this manner a highly flexible apparatus is achieved that can easily pass around corners while maintaining good contact with the pipe walls.

The invention will now be described, by way of example only, with reference to the accompanying drawings, in which.

Figure 1:
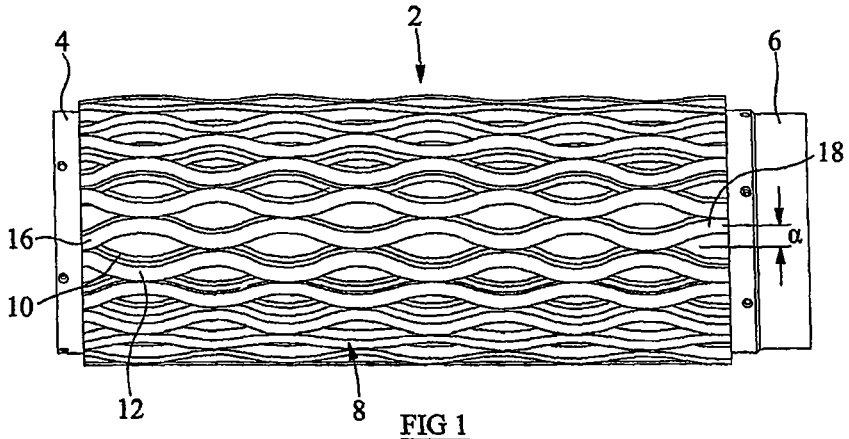
FIG. 1 shows a side view of a cleaning tool in accordance with the present invention.

Referring first to FIG. 1, there is shown a cleaning apparatus 2 comprising a first cylindrical collar 4, a second cylindrical collar 6 and a plurality of elongate cleaning elements 8 in the form of strip brushes disposed between the first cylindrical collar 4 and the second cylindrical collar 6. Such an apparatus 2 has particular utility as a down-hole pipe cleaner.

The use of the first and second cylindrical collars 4,6 means that a high degree of bypass through the cleaning apparatus is provided for.

Each of the strip brushes comprises a backing element 10 to which are secured a continuous strip of bristles 12 making up the brush. Conveniently, the backing element 10 may be stainless steel to provide a robust flexibility to the apparatus. However any suitable material may be used. The bristles 12 may be of any suitable material for example of steel. Such strip brushes are relatively inexpensive such that the apparatus 2 can, if desired, be disposed of rather than being reconditioned after a first useful life has been obtained from the apparatus 2.

In the illustrated embodiment, the strip brushes are of undulating sinusoidal form. In adjacent brushes the crests and valleys of each strip brush are offset so as to create radial openings in the apparatus between adjacent brushes. These openings allow and debris cleaned from the interior of the pipe to pass through the openings away from the brushes which assists in preventing the brushes becoming blocked. As, in use, there is a bypass of fluid through the centre of the cleaning apparatus any debris passing through the radial openings will become entrained in the fluid flow and carried away from the cleaning apparatus. Thus the risk of clogging of the brushes is reduced.

Figure 2:
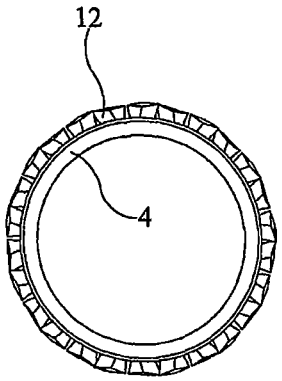
FIG. 2 shows an end view of the cleaning tool shown in FIG. 1.

The arrangement of the strip brushes in this manner also ensures that a full 360 degree contact with the surface, as seen in a longitudinal direction, can be maintained (as may be seen from FIG. 2).

Further, the high degree of bypass through the centre of the apparatus means that the apparatus can be used to clean a pipe without creating a blockage in the pipe or creating any substantial pressure spikes as can be created when using passing an apparatus with capabilities for little or no bypass through it through a pipe.

Figure 3:
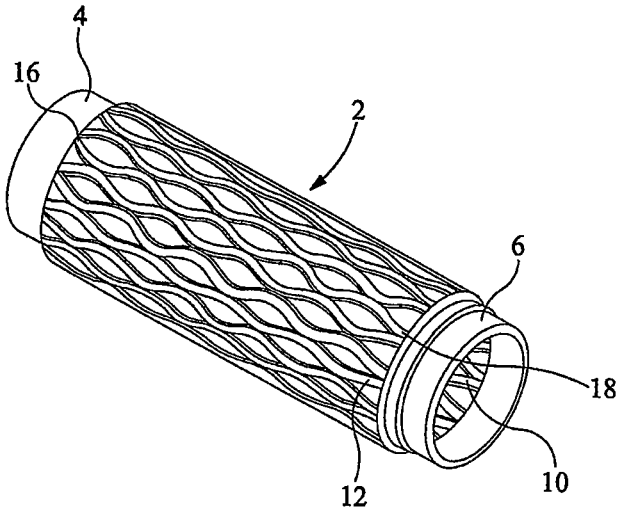
FIG. 3 shows a perspective view of the cleaning tool shown in FIG. 1.

The strip brushes are secured at each end about a peripheral edge of each of the first and second cylindrical collars 4, 6 by any suitable means. In the illustrated embodiment, it will be seen that a first end 16 of a strip brush is secured to the first cylindrical collar 4 at a first angular position and a second end 18 of the strip brush is secured to the second cylindrical collar 6 at a relatively offset angular position ($\alpha$). This is most clearly shown in FIGS. 1 and 3. This arrangement leads to a generally helical pattern being formed by the strip brushes. This in turn means that the fluid flow imparts a rotational component to the movement of the apparatus 2 in the passage increasing the efficiency of cleaning of the apparatus 2.

The strip brushes are not connected to one another in a region extending between the first cylindrical collar and the second cylindrical collar. This allows for bending and flexing of the cleaning apparatus, such that jamming of the cleaning apparatus within a pipe may be avoided. In particular, as the apparatus passes down a pipe, and slight bending moments in the apparatus, whether caused by the apparatus passing round a curve in a pipe or by a slight imbalance of fluid forces on the apparatus, adjacent strip brushes can flex independently of one another and their surfaces move slightly with respect to one another giving the whole apparatus greater flexibility. The combination of this flexibility with the turning motion that is provided in use by the helical pattern of the strip brushes can be particularly advantageous for preventing the cleaning apparatus from becoming jammed in use.

The flexible nature of the strip brushes also means that the apparatus as a whole has a high degree of flexibility enabling the apparatus to be used to clean passages having relatively tight curves or bends.

In the illustrated embodiment, the cleaning apparatus is adapted to be driven by a flow of fluid through the cleaning apparatus. In an alternative embodiment, not shown, the cleaning apparatus is adapted to be connected to a central shaft, movement of the shaft along a pipe determining the movement of the cleaning apparatus along the pipe, that is the central shaft is used to advance and retract the cleaning apparatus along the pipe.

The invention claimed is:

1. A cleaning apparatus comprising a hollow first cylindrical end collar, a hollow second cylindrical end collar and a substantially tubular cleaning section, open at each end, extending therebetween, wherein the tubular cleaning section comprises a plurality of elongate strip brushes disposed between the first cylindrical collar and the second cylindrical collar and arranged such that there are radial openings in the tubular cleaning section between said elongate strip brushes wherein each strip brush is of an undulating configuration along its length; and wherein said elongate strip brushes are arranged adjacent one another around the circumference of said first and said second cylindrical end collar, such that, the crests and valleys of the undulations of each adjacent strip brush are offset in a direction along the length of the cleaning apparatus.

2. A cleaning apparatus according to claim 1 in which the strip brushes are sinusoidal in configuration.

3. A cleaning apparatus according to claim 1, in which a first end of each strip brush is connected to the first cylindrical collar at a first point and a second end of each strip brush is connected to the second cylindrical collar at a second point, the first and second points being angularly offset from one another.

4. A cleaning apparatus according to any one of claims 1, 2 or 3, in which the first cylindrical collar and the second cylindrical collar are connected only by the strip brushes.

5. A cleaning apparatus according to any of claims 1, 2, or 3, in which the strip brushes are not connected to one another in a region extending between the first cylindrical collar and the second cylindrical collar.

* * * * *